US006460446B1

(12) United States Patent
Kathe

(10) Patent No.: US 6,460,446 B1
(45) Date of Patent: Oct. 8, 2002

(54) SONIC RAREFACTION WAVE RECOILLESS GUN SYSTEM

(75) Inventor: Eric L. Kathe, Ballston Lake, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/631,142

(22) Filed: Aug. 2, 2000

Related U.S. Application Data

(60) Provisional application No. 60/152,214, filed on Sep. 3, 1999.

(51) Int. Cl.[7] ..... F41A 1/08
(52) U.S. Cl. ..... 89/1.703; 89/14.05
(58) Field of Search ..... 89/14.05, 14.3, 89/1.703; 42/76.01

(56) References Cited

U.S. PATENT DOCUMENTS 4,043,248 A * 8/1977 Bulman et al. ..... 89/1.703
5,109,748 A * 5/1992 Bertiller et al. ..... 89/1.2
5,381,722 A * 1/1995 Begneu ..... 89/7
5,404,790 A * 4/1995 Averbukh ..... 89/193
5,834,678 A * 11/1998 Kalb ..... 89/187.01
5,841,057 A * 11/1998 Birk ..... 89/1.25
6,089,139 A * 7/2000 Russel ..... 89/14.05

FOREIGN PATENT DOCUMENTS

DE 548102 * 4/1932 ..... 42/76.01

* cited by examiner

*Primary Examiner*—Stephen M. Johnson
(74) *Attorney, Agent, or Firm*—Michael Sachs; John Moran

(57) ABSTRACT

A low recoil and low bore heat gun system provides a delayed pressure release mechanism for fired propellant charges in the rear gun barrel section. The delayed pressure release of the exhaust gases causes a sonic rarefaction wave along the length of the barrel bore to arrive at the exist end of the gun barrel at a predetermined time, generally coincident with the fired projectile.

12 Claims, 8 Drawing Sheets

SONIC RAREFACTION WAVE RECOILLESS GUN SYSTEM

RELATED APPLICATIONS

This application claims benefit of filing date Sep. 3, 1999 of provisional application 60/152,214 now abandoned, the entire file wrapper contents of which application are herewith incorporated by reference as though fully set forth herein at length.

GOVERNMENT INTEREST

The invention described herein may be manufactured, licensed, and used by or for the U.S. Government.

BACKGROUND OF THE INVENTION

1. Field of the Invention

This invention relates to a low recoil and low bore heat gun system. In particular, the low recoil gun system uses a delayed pressure release mechanism of the fired propellant charge. More particularly, the delayed pressure release of the exhaust gases causes a sonic rarefaction wave along the length of the barrel bore to arrive at the muzzle end of the gun barrel at a predetermined time, generally coincident with the fired projectile. The mechanism of the present invention allows a maximum amount of energy to be imparted into the fired projectile.

2. Brief Description of the Related Art

Recoil from a fired vehicle mounted gun system causes excessive motion of the vehicle, at times, creating the possibility of toppling the vehicle or causing extreme discomfort to the gun crew. As stated by Newton's third law of motion, i.e., to every action there is always opposed an equal reaction, the momentum manifest within a gun system during the weapon launch is equal and opposite to sum of the momentum which is imparted to the projectile launched from the gun system, including the propellant gases that are subsequently ejected from the gun system. Minimizing the recoil increases the utilization of these gun systems.

Several methods are known to reduce the total forward momentum imparted during the launch of a projectile from a gun system. Momentum, as a vector quantity, does not dissipate as kinetic energy does, which is a scaler quantity. For a traditional gas gun, the launch momentum equals momentum imparted to the projectile, and the propellant gas that follows the projectile out of the muzzle. For a given projectile momentum, the total launch momentum may be reduced by redirecting the forward moving propellant gas to lower its forward speed, or reverse it.

Alternatively, some other inertia may be ejected out of the gun in the opposite direction from the projectile to achieve some degree of momentum cancellation.

All guns are subject to recoil, thus the problem has exited ever since the invention of the gun. The first known concept of a recoilless gun was sketched by Leonardo da Vinci (1452–1519) in which a gun fired two projectiles; one forward and one rearward, to balance the momentum. During World War I, Commander Cleland Davis, United States Navy, reduced the two projectile gun to practice. The Davis gun fired an ordinance projectile at the target, and a dummy projectile of Vaseline and lead dust, having an equal mass to the ordinance projectile, was fired in the opposite direction. The original Davis gun used a cannon that was open at both ends and loaded in the middle, and was apparently intended to target high altitude Zeppelins. Problems with the Davis gun include hazards to friendly forces from the rearward fired projectile and subsequent muzzle blast, added system weight from a second barrel and additional charge needed to obtain equal fire power of the projectile, and containing pressure in two directions. As such, the Davis gun has logistical burdens, munitions handling problems of heavy ammunition, a high system weight, and double length gun barrels that may limit mobility of a fighting vehicle.

Other developments in eliminating recoil from gun systems resulted in recoilless guns. Recoilless guns incorporated a nozzle in the breech to eject propellant gases out of the rear of the gun, permitting part of the propellant gas to flow backward and counter-balance the momentum of the fired projectile and any propellant that was propelled forward. A gun system that incorporated diversion of propellant gases through a nozzle located at the breech was developed by the Russians in 1936 using a design from a patent filed in 1917 by the Russian mathematician Riabouchinski. During World War II, United States Army Colonel René R. Studler, at the Research and Development Service of US Army Ordnance, developed a lightweight recoilless gun resulting in a shoulder fired weapon that could propel a three pound (1.36 Kg) explosive shell with a muzzle velocity of 1200 feet per second (366 m/s). The recoilless concept is used in the U.S. Army M40AD 106 -mm recoilless rifle that allows propellant gases to escape through a perforated chamber case between the projectile and breech, and the German LG 42 105 mm recoilless Howitzer that uses a bursting disk located at the breech to contain the propellant through ignition as opposed to a perforated chamber. Problems with recoilless rifles include poor ignition characteristics of propellant within the open chamber system, ejection of unburned propellant through the nozzle, erosion problems in large caliber direct-fire tank cannons from created pressures and temperatures (limiting recoilless guns to relatively low pressure applications), loss of substantial amounts of chemical energy from the propellant, added cost and weight from a perforated cartridge to contain the propellant while it burns, revealing back-blasts that also hazard firing crews, and limited nozzle design for recoilless rifles dictated by interior ballistic pressure.

Recoilless guns also have been developed using front orifices developed by the Frigidaire Division of the General Motors Corporation in collaboration with the Armour Research Foundation in the early 1950's. The front orifices allow the ignition process to occur in a closed chamber, increasing efficiency. The gun initially behaves as a conventional weapon. However, shortly after the projectile begins to travel down the bore of the gun barrel, orifices integrated within the gun barrel that lead to a rearward facing contraction expansion nozzle are uncovered by the projectile obturator, allowing propellant gases to be vented from the gun and achieve forward thrust for recoil cancellation. Problems with a front orifice recoilless rifle include adequate ducting of escaping rearward muzzle gases at a substantial distance along the bore from the rear of the weapon, reduced pressure behind the launching projectile after the orifice is enabled and throughout the remaining duration of the ballistic cycle, limited chamber pressure, increased ammunition weight, and the initial imbalance in recoil loads requires a flexible, i.e., heavier and more complicated, mount to accommodate the initial rearward motion of the gun system prior to the uncovering of the orifices and their recoil mitigation effect. As such, recoilless and front orifice rifles present a logistical burden and munitions handling of heavy ammunition relative to that achievable with a traditional closed breach gun system, limited internal ballistic pressure, and an inability to operate in a closed-breech mode when firing low impulse rounds.

Muzzle brakes may be used to reduce firing impulses. French Colonel Chevalier Truielle de Beaulieu, in 1842, recorded the first known diversion of propellant gas using a crude muzzle brake to reduce the combined launch momentum. Muzzle brakes deflect the gases flowing out of the muzzle thus redirecting a substantial portion of the gas momentum. The efficiency of muzzle brakes generally ranges between 30 and 40 percent, with exceptional muzzle brakes achieving efficiencies as high as 70 percent. In this context, the muzzle brake efficiently is defined as the percentage reduction in the kinetic energy imparted to the recoiling gun system mass. During launch, the projectile is propelled by the high pressure propellant gases and when the rear of the projectile exits the main gun barrel it enters the muzzle brake. The muzzle brake allows the propellant gases to escape from behind the fired projectile. Through a combination of further gas expansion, and redirection of the gas flow, the net forward momentum of the propellant gases may be dramatically reduced, or even reversed by the muzzle brake. Problems with muzzle brakes include crew hazards from the excessive over-pressure of the blast, i.e., air disturbances or propellant gas moving at high velocity, loud noise and heat, creation of debris in the air obfuscating targets, added weight and cumbersome barrel redirection, limitations to end barrel use, and that high velocity gases remain to follow the projectile straight out of the muzzle brake unimpeded. As such, muzzle brakes present reduction of the recoil energy of a gun system by more than half, a health hazard, reduced vision in front of the gun, added weight to the end of the cannon and reduced projectile exit velocity (by reducing the pressure at the base of the projectile prior to exit from the gun system).

Heat imparted to the bore of a gun during firing may result in unacceptable temperature increase of the of the gun, and will accelerate the wear and erosion of the bore. The former consideration may limit the sustained rate of fire, while the latter may limit the life of the gun. The heat transfer to the gun is governed by complex partial differential relationships between the temperature, density, and velocity of the gas, and its interaction with the bore surface. The heat transfer coefficient as proportional to the velocity of the gases washing over the bore surface and the density of the gases. The net heat transfer integrates the rate of heat transfer over the duration of the exposure, therefore heat transfer also increases in kind with duration. Experimental evidence has shown substantial increase of bore erosion with bore temperature. In simple terms, the hotter the bore, the less resistant the material is to removal by wear and erosion. Current technology to reduce heat transfer to the bore surface during firing includes using cooler propellants and boundary layer cooling, both of which are not counter to the teaching of the present invention. Cooler propellants reduce heat transfer by reducing the temperature gradient between the propellant gas and bore surface, however, cooler propellants inherently have reduced impetus, i.e., energy. Boundary layer cooling includes ablative and smear cooling methods as outlined in A. J. Bracuti, "Wear-Reducing Additives—Role of the Propellant," in *Gun Propulsion Technology*, Edited by Stiefel, AIAA Volume 109 Progress in Astronautics and Aeronautics, 1988, the disclosure of which is herein incorporated by reference. These techniques work by applying a fine coating to the bore surface during firing that is ablated away or by introducing favorable elements to the boundary layer near the wall to reduce convective heat transfer. Removal or sublimation of the ablative material is accelerated by the temperature of the propellant gases, and the velocity of the gas wash over the ablative material. It is well known from the Arrhenius equation and reaction kinetics that the rate of reaction increases exponentially with absolute temperature.

For large caliber armaments, heat transfer to the gun is resulting in the application of active cooling of the barrel, see for example, U.S. Pat. No. 5,837,921, to Christopher S. Rinaldi et al., entitled "Gun Barrel with Integral Midwall Cooling", as well as the development of specialized coatings to protect the bore from increased erosion.

Muzzle blast released after the projectile exits a gun appears to be a violent eruption of propellant gases. Muzzle blast generates flash, most predominantly secondary flash which occurs after hot propellant gases mix with ambient oxygen and re-combust. The column of hot gases following a round out of the gun result in shimmering that hampers the gunners ability to discern the damage inflicted upon the target. Dust raised by muzzle blast further complicates real time battle damage assessment. Blast deflectors have been applied to the muzzle end of guns to reduce these deleterious effects but are not totally effective.

Muzzle blast also unfavorably affects gun accuracy, such as yaw velocities being imparted to the projectile from transverse pressure gradients at shot exit and blast gases flowing forward over the fin surfaces after emergence from the muzzle (for fin stabilized projectiles) creating large destabilizing moment during a short time period.

In view of the foregoing, there is a need for improvements in minimizing the muzzle blast released after firing, the recoil of vehicle launched projectiles, and the heat transfer to the bore during firing. The present invention addresses these and other needs.

SUMMARY OF THE INVENTION

The present invention includes a low recoil low bore heat gun system comprising a barrel having a forward gun barrel section and a rear gun barrel section with the rear gun barrel section having a delayed pressure release mechanism for fired propellant charges.

The present invention also includes a projectile energy product created by the process comprising the steps of providing a low recoil and low bore heat gun system having a barrel with a forward gun barrel section and a rear gun barrel section, the rear gun barrel section having a delayed pressure release mechanism for a fired propellant charge and firing the projectile charge, wherein the exhaust gases from the fired projectile charge have a delayed release from the barrel.

The present invention further includes a method for imparting maximum energy to a fired projectile comprising the steps of providing a low recoil and low bore heat gun system having a barrel with a forward gun barrel section and a rear gun barrel section, the rear gun barrel section having a delayed pressure release mechanism for a fired propellant charge and firing the projectile charge, wherein the exhaust gases from the fired projectile charge have a delayed release from the barrel.

DETAILED DESCRIPTION OF THE PREFERRED EMBODIMENTS

The present invention comprises a sonic rarefaction recoilless gun system that dramatically reduces the recoil momentum imparted to a gun system. The sonic rarefaction wave recoilless gun system reduces the recoil momentum by expelling propellant gas at a delay interval from projectile firing. The sonic rarefaction recoilless gun system ejects substantial propellant gas out the rear of a gun system using a robust valve at the rear of the gun chamber, without necessarily affecting the interior ballistics that propel the projectile forward. The effectiveness of the system and method result from the limiting speed of the rarefaction wave that may travel forward down the bore towards the base of the moving projectile. A substantial delay time between "uncorking" the back of the gun breech and communication of the rarefaction wave forward means that the interior ballistic pressure driving the projectile is unaffected by having the back of the gun open. This is done without many of the disadvantages associated with traditional recoilless gun systems, and is based on the premise that the rarefaction wave can not travel faster than sonic speed in addition to the local velocity of the gases.

The present invention effectively achieves a benign muzzle blast, improves bore erosion resistance, and enhances ablative effectiveness. Maximum energy is imparted to a fired projectile, while achieving the benign muzzle blast, by venting propellant gases out the back of the gun. The release of a substantial portion of the propellant gas out the back of the gun dramatically reduces the quantity and energy of the propellant gases ejected out the front of the gun that would otherwise generate the deleterious muzzle blast. Reduced bore temperature reduces subsequent bore erosion. Further, reduction in the temperature of the propellant gas's through which the rarefaction wave has passed reduces the thermo-chemical drivers of erosion, particularly temperature. As the rarefaction wave progresses down the bore, the rate of chemical attack of the bore surface is reduced. Additionally a reduced rate of sublimation occurs while reducing gas wash removal of ablatives incorporated into the round for reduced bore heating and increased bore life. The ablative is more effective in protecting the bore from intimate contact with the hot propellant gases.

Figure 1:
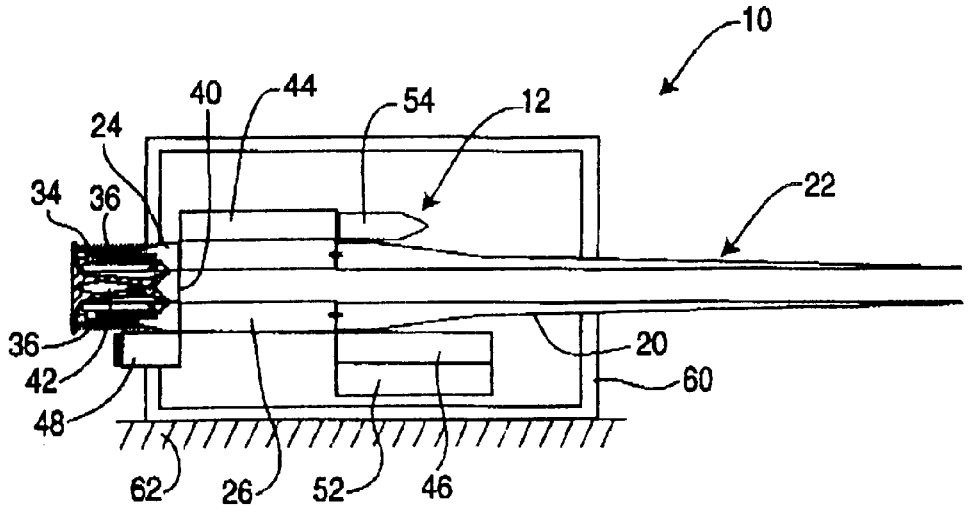
FIG. 1 illustrates the sonic rarefaction wave recoilless gun system of the present invention.
Figure 1A:
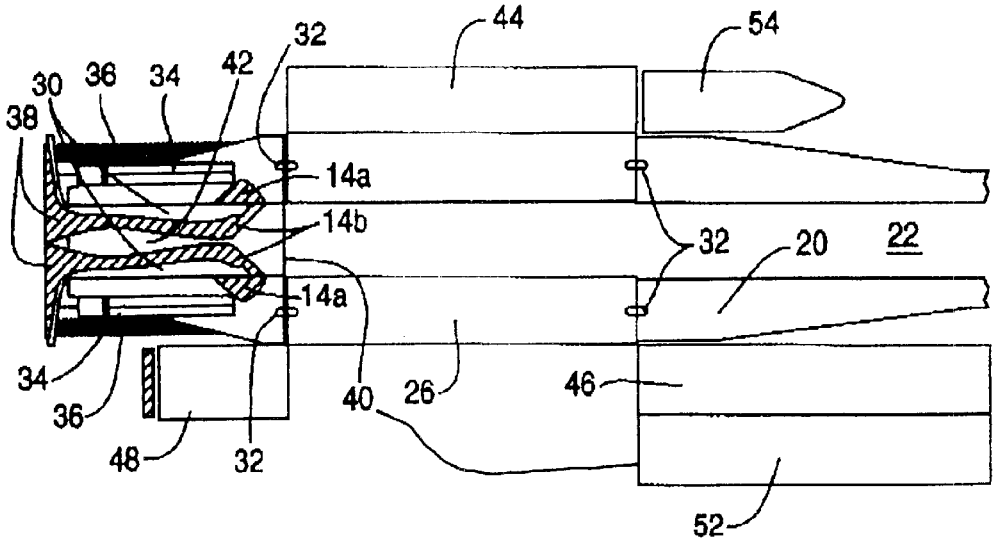
FIG. 1A illustrates an enlarged view of the rear section of the gun system shown in FIG. 1.

As seen in FIG. 1 the sonic rarefaction wave recoilless gun system 10 of the present invention is illustrated, showing a diagramed segmentation of the component parts. The sonic rarefaction wave recoilless gun system 10 includes a gun system 12 supported in a turret structure 60 attached to a hull 62 or other like platforms. Propellant gas is created upon burning of the propellant charge 52 which releases high energy gas. The gas propels the projectile 54 down the bore of a forward gun barrel section 22. As further seen in FIG. 1A showing an enlarged rear section of FIG. 1, upon sufficient rearward recoil travel of the stub case 40 and inertial breech 42, the energy and momentum of the gas is vented through barrel scallops 14a and breech scallops 14b for expansion within an expansion nozzle 38 with final release to the ambient atmosphere. In directing the propellant gas in this manner, the propellant gas is used to reduce the recoil of the inertial breech 42.

One preferred embodiment of several venting mechanisms for the present invention includes the inertial breech 42 as described in U.S. patent application, Ser. No. 09/363,700, filed Jul. 16, 1999, entitled "The Inertial Breech Gun System" to the present inventor Eric Kathe, the disclosure of which is herein incorporated by reference, to provide a robust chamber valve action to enable the delayed release of the rarefaction wave. The inertial breech 42 provides highly predictable timing, and is robust with respect to variation in the interior ballistics. The inertial breech 42 constitutes a delayed pressure release 42. Alternative mechanisms to achieve a delayed pressure release non-exclusively include cam actuator devices where a valve is thrown open as the carnon recoils rearward-and engages a cam that is coupled to the mount, gas-operated devices where the projectile may uncover a-forward orifice during filing that drives a piston and actuates the valve, or rupture disks engineered to rupture after peak pressure through an external trigger or through the ablation and undermining of the support structure by the hot propellant gases. Other mechanisms include shaped-charge devices and computer actuators. These mechanisms may be used with the present invention as determined by those skilled in the art in light of the disclosure herein.

The gun system 12 of the sonic rarefaction wave recoilless gun system 10 includes a barrel 20 having a forward gun barrel section 22 and rear gun barrel section 24. The forward gun barrel section 22 is preferably fixed to the turret structure 60 and does not recoil. The forward gun barrel section 22 contains the gas pressure that propels the projectile 54 forward, while constraining the path of the projectile 54 to follow the center line profile -of the bore. When fixed to the turret structure 60, external structures between the hull 62 and barrel 20 may be employed to leverage the structural integrity of the turret structure 60 to enhance the integrity of the barrel 20, such as using a truss or buttress.

The rear gun barrel section 24 of the barrel 20 is fixed to the turret structure 60 and contains the recoiling inertial breech 42 and propellant gas pressure during launch. Barrel scallops 14*a* located within in the rear gun barrel section 24 enable the engineered escape of propellant gas through the inertial breech 42 and its expansion nozzle 38 to the ambient atmosphere. The rear gun barrel section 24 may be allowed to translate modestly rearward and forward to facilitate the formation of effective chamber seals 32. Additionally, the barrel 20 includes a slide chamber section 26 that is fixed to the forward gun barrel section 22 and rear gun barrel section 24. The slide chamber section 26 translates laterally to enable loading of rounds. The forward gun barrel section 22, slide chamber section 26, and rear gun barrel section 24 do not recoil relative to the turret structure 60 during firing, but may be allowed to slide forwards or rearwards a modest amount to facilitate the formation of effective chamber seals 32.

A recoil brake 34 may be required to oppose the recoil motion of the inertial breech 42. If the forward momentum imparted to the inertial breech 42 by the thrust of the propellant gas as it is vented through the expansion nozzle 38 is less than the momentum imparted to the inertial breech 42 by the pressure applied by the propellant gas against the stub case 40, the remaining momentum and its associated kinetic energy of the recoiling inertial breech 42 will have to be compensated and extracted respectively by the combined effect of the recoil brake 34 and recuperator 36. The kinetic energy extracted from the inertial breech 42 by the recoil brake 34 will be converted to the heat by some means of energy dissipation such as the flow hydraulic fluids through restrictive orifices, i.e., shock absorbers. A secondary function of a recoil brake 34 is to slow the motion of the inertial breech 42 as it is returned to battery, i.e., start position, after the rearward recoil stroke is completed, commonly called buffering.

Although similar in function to the recoil brake 34, the recuperator 36 functionally differs. Rather than dissipation of the kinetic energy of the recoiling inertial breech 42 as is achieved by the recoil brake 34, the recuperator 36 converts the kinetic energy to stored potential energy; typically manifested as spring energy within a column of inert gas, such as nitrogen. This stored potential energy is generally used to return the inertial breech 42 forward to its battery position. The stored potential energy may also be use for other desired functions such as using an electrically based recuperator 36 to store electrical energy for later use by any on-board systems.

The inertial breech 42 provides for axial containment of the propellant gas pressure using the inertia of the breech assembly 42. The inertial breech 42 is propelled rearwards by propellant gas pressure, but also applies a D'Alembert containment load to limit the conversion of the chemical energy released from the propellant charge 52 upon its combustion into "wasted" kinetic energy of the inertial breech 42. As the purpose of the sonic rarefaction wave recoilless gun system 10 is to provide kinetic energy to the projectile 54, the portion of energy "wasted" on the inertial breech 42 is inversely proportional to the ratio of mass of the inertial breech 42 to the projectile 54 and the effective contribution of the propellant gas mass, nominally one third. Integral within the inertial breech 42 are the breech scallops 14*b* and the expansion nozzle 38. The greater the effective mass of the inertial breech 42, the better its performance with respect to reduced recoil kinetic energy. Thus, integration of the expansion nozzle 38 function within the inertial breech 42 constitutes system functional design synergy.

A projectile transfer sleeve 44 is attached to one side of the slide chamber section 26. The projectile transfer sleeve 44 contains the projectile 54 prior to loading the gun system 12 and moves with the slide chamber section 26 during its opening and closing. When the slide chamber section 26 is open, the inside of the projectile transfer sleeve 44 is aligned with the bore of the forward gun barrel section 22. During the loading process, when the slide chamber section 26 is open, an actuation device within the projectile transfer sleeve 44 pushes the projectile 54 forward into the rear end of the forward gun barrel section 22. Actuation may be by pneumatic, furlable boom, stiff-back chain, articulated arm mechanisms, a human hand or other known actuation methods. The projectile transfer sleeve 44 also accepts the projectile 54 from stowed ammunition while the slide chamber section 26 is closed, so that it is ready to ram the projectile 54 into the rear of forward gun barrel section 22 when the slide chamber section 26 is opened. The capability to unload a previously loaded projectile 54 also is contemplated within the scope of the present invention. A means for securing the projectile 54 within the bore of the forward gun barrel section 22 is preferred, such as through small notches within the bore of the forward gun barrel section 22 to which a lock mechanism integral with the projectile 54 structure engages or having a lip on the rear face of the forward gun barrel section 22. These possible position locking mechanisms would be disengagable to permit unloading of rounds locked within the bore.

A propellant transfer sleeve 46 is preferably mounted parallel and adjacent to the forward gun barrel section 22 on the opposite side of the projectile transfer sleeve 44. The propellant transfer sleeve 46 contains the propellant charge 52 with integral sub case 40 prior to loading the gun system 12. The propellant transfer sleeve 46 is positioned such that the inside of the propellant transfer sleeve 46 is aligned with the bore of the slide chamber section 26 when it is opened. During the loading process, when the slide chamber section 26 is open, an actuation device within the propellant transfer sleeve 46 pushes the propellant charge 52 rearward into the forward end of the slide chamber section 26. Actuation may be by pneumatic, furlable boom, stiff-back chain, articulated arm mechanisms, a human hand or other known actuation methods. The propellant transfer sleeve 46 is capable of accepting a propellant charge 52 from stowed ammunition while the slide chamber section 26 is closed, so that it is ready to ram the propellant charge 52 into the front of the slide chamber section 26 when the slide chamber section 26 is opened. The capability to unload a previously loaded propellant charge 52 also is contemplated within the scope of the present invention.

A resupply and ejection sleeve 48 is mounted parallel and adjacent to the rear gun barrel section 24 on the opposite side of the projectile transfer sleeve 44. The resupply and ejection sleeve 48 may accomplish three purposes: ejection of the hot stub case 40 that remains within the slide chamber section 26 after firing, transferring ammunition 50 through the turret structure 60 during resupply, and ejection of any rounds that are damaged or for other reason are no longer desired within the turret structure 60. The resupply and ejection sleeve 48 is positioned such that the inside of the resupply and ejection sleeve 48 is aligned with the bore of the slide chamber section 26 when it is opened. During the loading process, when the slide chamber section 26 is open, an actuation device within the propellant transfer sleeve 46 pushes the propellant charge 52 rearward into the forward end of the slide chamber section 26. This in turn ejects the hot stub case 40. Actuation may be by pneumatic, furlable boom, stiff-back chain, articulated arm mechanisms, a human hand or other known actuation methods. The resupply and ejection sleeve 48 contains a hatch or door to prevent the exposure of the turret atmosphere to the possibly contaminated ambient atmosphere.

The chamber seals 32 are used at the interfaces between the forward gun barrel section 22 and the slide chamber section 26 as well as the rear gun barrel section 24 and the slide chamber section 26. The chamber seals 32 prevent the escape of high pressure propellant gas within the bore of the forward gun barrel section 22, slide chamber section 26, and rear gun barrel section 24 from entering the turret atmosphere. Modest translation of the slide chamber section 26 and rear gun barrel section 24 forward and rearward may facilitate enhanced seal pre-loads, improving performance. Other methods of achieving chamber seals 32 may not require such forward and rearward translation. As no substantial axial loads are applied to the gun system 12 as long as the exposed area of the rear face of the projectile 54 and front face of the inertial breech 42 are the same, no appreciable variations in the bore diameter exist within or between the forward gun barrel section 22, slide chamber section 26, and rear gun barrel section 24. Such a straight bore may be termed a "prismatic bore." Unlike the present invention, a traditional gun undergoes substantial tension load as the high pressure propellant gas pushes the structurally coupled breech rearwards, thus pulling the gun barrel along with it. Also absent in the present invention is the axial tension caused by variation in chamber diameter at the forcing and/or chambrage cone of a traditional gun system.

The breech seal 30 comprises a low pressure seal behind the breech scallops 14*b* and barrel scallops 14*a* clearances between the rear gun barrel section 24 and inertial breech 42. The breech seal 30 is located behind the seal achieved by the stub case 40 and used to achieve a seal after the rearward recoil of the inertial breech 42 and stub case 40 have enabled propellant gas to be discharged. It should occur after substantial travel of the projectile 54 down the bore of the forward gun barrel section 22. At such a point in the interior ballistic cycle, the pressure of the propellant gas should be far below its peak pressure, avoiding the highest pressures of the interior ballistics cycle and reducing the deleterious wear and erosion effects that occur along the flow path of the propellant gas through the barrel scallops 14*a* and internal structure of the inertial breech 42 with eventual release to the ambient atmosphere.

The propellant charge 52 contains the chemical energy to propel the projectile 54 and endows the projectile 54 with considerable kinetic energy before it is discharged out the muzzle of the forward gun barrel section 22. Upon ignition, the propellant charge 52 undergoes combustion, releasing vast amounts of thermal energy while changing state to form propellant gas. The propellant charge 52 is engineered to release its chemical energy in a controlled fashion, to maintain a desired pressure profile during the interior ballistics of launch. Integral with the propellant charge 52 is a stub case 40. The structural integrity of the propellant charge 52 must be sufficient for munitions handling and logistical delivery to the battle field.

Figure 2:
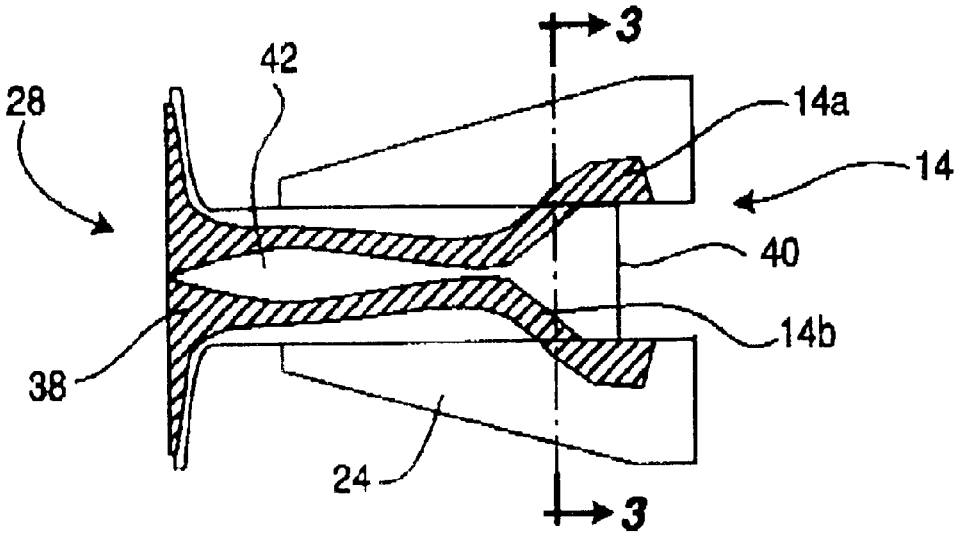
FIG. 2 illustrates an enlarged view of the breech of the gun system shown in FIG. 1.

As shown in FIG. 2, the interaction of the barrel scallops 14*a* and breech scallops 14*b* create a breech valve 14 within the breech of the gun system 12 that enables the release of propellant gas pressure during the interior ballistic launch cycle. The delayed release may occur at any appropriate time as determinable by those skilled in the art, such as when the fired projectile has traversed a given distance along the length of the barrel or other given criteria. For example, release of the propellant gas pressure may occur when the fired projectile has traveled from about ¼ to about ½ of the length of the barrel. The breech valve 14 is achieved by the uncovering of the barrel scallops 14*a* when the inertial breech 42 has recoiled rearward sufficiently that the stub case 40 exposes the barrel scallops 14*a* to the propellant gas contained within the bore of the rear gun barrel section 24. The inertial breech 42 used as the pressure release mechanism may be described as a momentum activated release component. The same propellant gas column force that propels the ordnance projectile forward, also propels the inertial breech 42 rearward with nearly equal momentum imparted to each. As the breech scallops 14*b* are exposed by the movement of recoiling gun parts, propellant gas is allowed to flow from the gun system 12 into the opened orifices providing pressure release conduits. The timing of the pressure release is achieved by geometrically controlling the exposure of the scallops 14*a* and 14*b* as a function of inertial breech 42 position which is a function of the momentum imparted to the breech. Effective breech valve 14 opening may be dictated by sufficient impulse of each round to propel the inertial breech 42 rearwards to expose the barrel scallops 14*a* while the propellant gas is still of considerably higher pressure than the ambient atmosphere, as well as the geometry and design of the stub case 40 to control the operation of the breech valve 14 by changing the distance of the inertial breech 42 recoil before uncovering the barrel scallops 14*a*. The impulse of the projectile or round relates to the launch momentum associated with a given round of ammunition. The breech valve 14 may be designed not to open during the firing of low impulse rounds to provide the option for close-breech operation, with the design of such breech valves 14 being determinable by those skilled in the art in light of the disclosure herein. Additionally a variable throat area may be enabled by staggering the start locations of the barrel scallops 14*a* that enables the throat area exposed to the high pressure propellant gas to increase as additional barrel scallops 14*a* are uncovered during recoil traversal of the inertial breech 42. Any means for establishing a breech valve 14 within the gun system 12 that may be opened during the firing of a round and establish a sonic rarefaction wave within the barrel 20 should be acceptable. Such means for establishing a breech valve 14 may include mechanical, electromagnetic, hydraulic, pyrotechnic, or other applicable actuation of a breech valve 14 while propellant gas pressure exerts pressure upon the bore that is greater than the ambient atmospheric pressure.

The stub case 40 comprises a rigid plate applied to the back of the propellant charge 52. The stub case 40 facilitates autoloading of the propellant charge 52 as well as providing a disposable seal between the pressure of the propellant gas and the bore of the rear gun barrel section 24. The stub case 40 also dramatically reduces heat transfer across the front face of the inertial breech 42 during firing. Preferably, the stub case 40 hastens the release of high pressure propellant gas when the barrel scallops 14*a* are first revealed through some designed mode of localized failure, e.g., bum or burst through engineered tabs in the sides of the stub case 40. The stub case 40 may also comprise an ablative material to reduce erosion of the barrel scallops 14*a*, breech scallops 14*b*, and expansion nozzle 38. Further, the stub case 40 may be designed to fine tune the timing of exposure of the barrel scallops 14*a* to the high pressure propellant gas, i.e., a thick stub case to retard the exposure of the barrel scallops 14*a* to the high pressure propellant gas.

Figure 3:
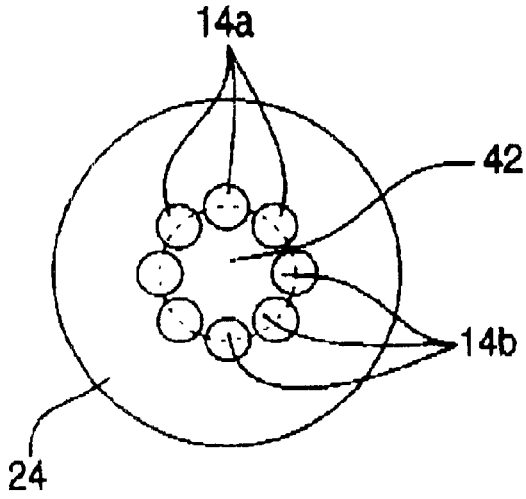
FIG. 3 is a cross-sectional view of the scallops in an open position of the gun system shown in FIG. 1.

FIG. 3 shows a cross-sectional view of the scallops of the gun system 12 in an open position. The barrel scallops 14*a* are machined into the bore of the rear gun barrel section 24 and provide a flow path for propellant gas to escape the interior of the slide chamber section 26 (shown in FIG. 1) while still maintaining substantial circumferential contact with the inertial breech 42, constraining the propellant gas to follow the center-line of the rear gun barrel section 24. As seen in FIGS. 2 and 3, the barrel scallops 14*a* start at a distance behind the front face of the inertial breech 24 at the battery position. Flow of propellant gas is enabled once the seal formed by the stub case 40 is propelled rearward by the recoil motion of the inertial breech 42 and stub case 40, which exposes the opening of the barrel scallops 14*a* to the pressurized propellant gas contained within the bore of the rear gun barrel section 24 forward of the stub case 40. The distance of the barrel scallops 14*a* behind the battery position dictates the "valve timing" of propellant gas release during the interior ballistic cycle. As the barrel scallops 14*a* are not exposed to the pressurized propellant gas until the inertial breech 42 has recoiled rearward appreciably, the pressure encountered is generally below the maximum pressure attained during the interior ballistics cycle. This minimizes any affect on the structural integrity of the rear gun barrel section 24 at the barrel scallops 14*a* where the peak hoop integrity demands are placed upon the structure. The geometry of the scallops 14*a* and 14*b* may enable the flow passage between the breech scallops 14*b* and barrel scallops 14*a* to achieve a controlled variable throat area, or may be staggered to open additional throat area as a function of recoil displacement. The expansion ratio for a converging and diverging nozzle 28 as achieved between the convergence within the scallops 14*a* and 14*b* and the divergency of the expansion nozzle 38 dictates whether the vented propellant gas is under or over expanded. Under expanded gases are discharge without developing the full thrust; over expanded gases result in shock wave formation within the expansion nozzle 38.

The breech scallops 14*b* are integral within the inertial breech 42 and provide a path for escaping propellant gas to flow from the barrel scallops 14*a* to the expansion nozzle 38. This is accomplished without undermining the substantial circumferential contact with the rear gun barrel section 24 in relation to the barrel scallops 14*a*. The breech scallops 14*b*, when aligned with the barrel scallops 14*a*, provide an efficient flow path for the escaping propellant gas while providing ample mechanical constraint of the inertial breech 42 to follow the center line of the rear gun barrel section 24.

The expansion nozzle 38 is integral within the inertial breech 42, and efficiently converts the internal energy of the propellant gas into rearward momentum that will apply substantial thrust loads to the inertial breech 42; thus slowing in full or part the rearward recoil motion of the inertial breech 42. The expansion nozzle 38 enables propellant gas flow passing through the breech scallops 14*a* to be adiabatically expanded. The expansion nozzle 38 forms the second part of the converging/diverging, i.e., DeLaval, nozzle 28. The converging portion occurs along the prior flow path past the stub case 40, through the barrel scallops 14*a*, and into the breech scallops 14*b*. Preferably the nozzle also provides some measure of noise, flash, and smoke suppression of propellant gas released to the ambient atmosphere behind the expansion nozzle 38. Suppression of noise, flash and smoke is improved relative to muzzle brakes because of the location of the expansion nozzle 38 behind the breech. The weight the expansion nozzle 38 is applied behind the breech decreases the imbalance common to most long caliber gun systems that are cantilevered forward of the trunnions. A more substantial surface area for efficient expansion, and concurrent gas cooling, is far more practical at the rear of the turret than at the end of the muzzle. As such, the additional control of the gas expansion of the present invention provides better integrated noise, flash, and smoke suppression. The transition of the flow passages within the inertial breech 42 from the function of the breech scallops 14*b* to the function of the DeLaval nozzle 28 is gradual and can not be isolated to occur at a specific geometric point.

The expansion nozzle 38 completes the converging-diverging nozzle 28. The converging-diverging nozzle 28 within the recoiling gun system 12 allows the high pressure propellant gas that is released by the opening of the breech valve 14 to efficiently contract and expand. As such the converging-diverging nozzle 28 converts the internal energy of the propellant gas to thrust that is applied to counter the motion of the recoiling gun parts. The converging-diverging nozzle 28 is preferably directs the flow path of propellant gas from the bore of the rear gun barrel section 24 through the breech valve 14 that then ejects the propellant gas through the expansion nozzle 38. The converging portion of the converging-diverging nozzle 28 occurs as the propellant gas flows through the passage created between the barrel scallops 14*a* and breech scallops 14*b*. Stub case 40 design may limit the throttling affect on expansion nozzle 38 performance. The smallest normal flow area contained within the flow passage created between the barrel scallops 14*a* and breech scallops 14*b* achieves the throat area of the converging-diverging nozzle 28. The geometry of the barrel scallops 14*a* and breech scallops 14*b* may be designed to effect a variable throat area as the inertial breech 42 recoils rearwards, with the proper design determinable by those skilled in the art.

The converging-diverging nozzle 28 applies a substantial forward thrust as the propellant gas is ejected rearwards. As this thrust is both high, and of brief duration, the converging-diverging nozzle 28 may be considered to apply a shock load to the inertial breech 42. The inertial breech 42 is shock isolated from the turret structure 60 by the recoil brake 34 and recuperator 36 (shown in FIG. 1). Although the converging-diverging nozzle 28 function could be achieved by a structure separate from the recoiling gun parts, such a design would require two shock isolation systems, one for the gun and one for the converging-diverging nozzle 28. Integration of both functions within the inertial breech 42 represents functional design synergy of the preferred embodiment.

Referring to FIGS. 1-3, the projectile 54 includes the ordinance delivered by the sonic rarefaction wave recoilless gun system 10, and any ancillary structure, i.e., sabots for kinetic energy rounds, required for support during launch and obturation of the propellant gas. For example, when considered a rigid body mass that is propelled forward by the pressure of the propellant gas, the projectile 54 provides a seal between itself and the forward gun barrel section 22 that prevents the leakage of appreciable propellant gas forward of the projectile 54. Using the two part ammunition approach, i.e., separate projectile 54 and propellant charge 52, it is highly likely that practical implementation includes some propellant within the forward gun barrel section 22.

Upon the release of propellant gases at the breech of the gun system 12, a rarefaction wave travels along the bore of the gun barrel 20. This rarefaction wave can travel no faster than the speed of sound for the gases within which it is traveling, in addition to the local gas velocity (sonic barrier dictates that mechanical information can not be transmitted through a medium, i.e., propellant gas in this case, faster than the speed of sound within the medium). Other than minuscule thermodynamic effects caused by changes in radiant heat transfer traveling at the speed of light, the down bore interior ballistics are inherently unaffected by the opening of the breech valve 14 until the rarefaction wave arrives. By engineering of the timing of releasing breech gas, the sonic rarefaction wave may be caused to meet the base of the projectile contemporaneously with projectile 54 exit from the barrel 20, i.e., the breech may be "uncorked" and vent gases rearward prior to projectile 54 exit with no effect on the interior ballistic efficiency of projectile 54 launch. Timing the sonic rarefaction wave's arrival at the muzzle to occur prior to, contemporaneous with, or shortly after projectile 54 exit may dramatically reduce the energy released by the expanding propellant gases following projectile 54 exit.

The pressure reduction within the propellant column through which the rarefaction wave has progressed includes at least four favorable affects on the undesirable heat transfer to the bore surface. First, the density of the gas is reduced as the pressure is decreased. Second, the temperature of the gas is reduced as the pressure is decreased. Third, the forward acceleration of the gases within the bore is reduced; thus lowering the forward gas velocities. Fourth, the duration of the blow down, exiting of all gases after shot exit is reduced since gases will be exiting from both the breech and muzzle end. As heat transfer to the bore directly increases with increases of temperature, density, velocity and duration, venting the cannon reduces heat transfer to the bore. Reduced heat transfer and thus reduced bore surface temperature reduces wear and erosion; thus increasing barrel life and/or enabling the use of hotter propellants.

The pressure reduction within the propellant column through which the rarefaction wave has progressed, and subsequent ejection of a major portion of the propellant gases out the back of the gun has a favorable affect on the undesirable muzzle blast of a traditional cannon. Reduction in pressure of the propellant gas column decreases its temperature, and thus its enthalpy, reducing the velocities that the gases are capable of achieving as they expand after exiting. Further, the mass of gas ejected is reduced by the portion of gas vented out the back. Both of these phenomena tend to reduce the size, energy and intensity of the muzzle blast.

The sonic rarefaction wave recoilless gun system 10 includes the turret or armored structure 60 that constitutes the support of the gun system 12. The turret structure 60 may be fixed to a location, such as a fort and similar fortified structures, coupled to a mobile military asset, non-exclusively including aircraft, spacecrafts, and warships, or vehicles, such as a tank, self-propelled Howitzer and other like vehicles. The turret structure 60 includes a means for loading ammunition in the form of a propellant charge 52 and projectile 54 into the gun system 12, which is preferably automated. Generally, the turret structure 20 is coupled with the forward gun barrel section 22, with a permanently coupling preferred. As such, the complete turret structure 60 is pointed toward the intended firing direction, i.e., target, of the sonic rarefaction wave recoilless gun system 10. The sonic rarefaction wave recoilless gun system 10 may be used for armored fighting vehicles having an "oscillating" turret, such as or similar to the French AMX-13 light tank, turretless systems such as the Swedish Strv 103 (S-tank) where the gun is fixed to the hull instead of a turret, and external gun systems, i.e., pedestal mounting, such as the Teledyne Armored Gun System developed by General Dynamics Corporation. Gases within the turret structure 60, when present, are controlled for crew comfort and safety. Robotic vehicles or external gun mounts may be used to prevent the exposure exhaust gases to individuals having the chamber seals 32 meeting performance requirements for crew safety, with the design and fitting of the chamber seals 32 determinable by those skilled in the art. In the case of an external, i.e., pedestal mounted, gun, the atmosphere within the turret structure 60 equates to an ambient atmosphere, i.e., atmospheric air surround the fighting vehicle.

In an alternative embodiment, for a traditional closed breech gun system, where the breech, breech ring, and barrel all recoil rearwards together, the sonic rarefaction wave recoilless gun system may be achieved in several ways. Holes may be machined through the chamber of the gun that extend radially outward, with the outer diameter of the chamber at a local maximum and cylindrical for some distance forward of the holes. A non-recoiling secondary containment vessel that is coaxial with the gun barrel along and shortly behind the chamber contains the propellant pressure applied through the chamber holes during the early portion of the recoil stroke. This utilizes high pressure seals, as opposed to the low pressure seals of the breech seal 42 as previously described. Upon sufficient rearward recoil traversal of the recoiling cannon, the chamber holes are exposed to scallops within the secondary containment vessel. Scallops integral with the other diameter of the recoiling gun system behind the chamber provide a flow path for the propellant to pass from the secondary pressure vessel scallops to an internal flow path within the recoiling gun as the gun recoils rearwards. A contraction and expansion nozzle, integral within the recoiling gun system provides a flow path from the outer scallops of the recoiling gun, through the nozzle, for ejection to the ambient atmosphere. This achieves forward thrust applied through the nozzle to the recoiling gun to abate its recoil momentum.

Additionally, the gun system 12 may include an "ablative stub case" that includes a low pressure blow out plug containing a pin-hole throat that discharges propellant gases from the chamber into an axial symmetric expansion nozzle. This comprises a system that prevents substantial throat opening well past peak pressure, unlike a simple burst disk. This system allows the choked flow of the propellant gases through the pin-hole to ablate, burn, or otherwise undermine the structural integrity of the stub case causing a delayed collapse of the stub case. Upon its delayed collapse, the function of the ablative stub case follows in substantial analogy to that of the burst disks employed by German recoilless guns. The ablative stub case approach may provide for a disposable convergent nozzle and throat liner, dramatically reducing concerns of nozzle wear.

After the projectile 54 and propellant charge 52 are loaded, the propellant charge 52 is ignited to release high pressure propellant gas. The projectile 54 begins to move down bore while the inertial breech 42 begins to move rearwards with the stub case 40. As the propellant gas expands, pushing the projectile 54 down the bore of the forward gun barrel section 22, the temperature and pressure of the propellant gas falls. The inertial breech 42 and stub case 40 recoil rearwards, exposing the propellant gas within the chamber to the barrel scallops 14*a* of the rear gun barrel section 24 and creating a flow path for the propellant gas to escape through inertial breech 42. The propellant gas is expanded through the expansion nozzle 38 as it is introduced to the ambient atmosphere. The propellant gas driving the projectile 54 remains in front of the sonic rarefaction wave and is unaffected by the orifice exposure. Depending upon the objectives of the design, the sonic rarefaction wave will catch up to the projectile 54 coincident with projectile 54 exit from the gun system 12, with the timing achieved by the geometric design of the breech valve 14 opening using the recoil of the inertial breech 42 to expose the barrel scallops 14*a*. No loss in the interior ballistic performance of launch occurs even as propellant gas exists through the expansion nozzle 38 as the projectile 54 is propelled out the muzzle of the forward gun barrel section 22. The rearward recoil of the inertial breech 42 is substantially reduced at this point by the thrust achieved by the converging-diverging nozzle 28 as it discharges the propellant gas through the expansion nozzle 38 to the ambient atmosphere. During the period between the orifice exposure and projectile 54 exit the effects of the sonic rarefaction wave recoilless gun system is most significant. Within this period, the gun system 12 is recoiling like a recoilless gun with no loss in the interior ballistic performance of the weapon. Likewise, during this period a muzzle brake could not have yet begun recoil mitigation as a muzzle brake does not perform while the projectile is still in the bore. Although the duration of the traveling sonic rarefaction wave is limited, generally on the order of two milliseconds for a modem tank cannon, the pressure of the propellant gas at the breech of the gun system 12 is substantially higher than that which a muzzle brake would ever encounter. Depending upon the design, the rearward momentum of the inertial breech 42 imparted prior to orifice exposure is removed in all or part by the rearward ejection of the propellant gas through the expansion nozzle 38. The recoil brake 34 and recuperator 36 systems remove any remaining kinetic energy of the inertial breech 42, bring it to rest at the furthest extend of recoil. In the vent that a low impulse round was fired, no momentum of the breech is countered by the thrust of the converging-diverging nozzle 28. In this mode, the recoil brake 34 and recuperator 36 systems remove all of kinetic energy of the inertial breech 42 but the energy associated with a low impulse round will also be low. The energy stored within the recuperator 36 is used to position the inertial breech 42 back towards battery along with the hot stub case 40. Concurrently a new projectile 54 may be loaded into the projectile transfer sleeve 44 and a new propellant charge 52 may be loaded into the propellant transfer sleeve 46. Once the buffer of the recoil brake 34 has brought the inertial breech 42 back to battery, the projectile 54 has been loaded into the projectile transfer sleeve 44, and a new propellant charge 52 has been loaded into the propellant transfer sleeve 46, the slide chamber section 26 is ready to be opened. In order to facilitate the formation of chamber seals 32, the rear gun barrel section 24 and slide chamber section 26 are translated rearward slightly, with the rear gun barrel section 24 translating just a bit further to create equal gaps between the front and rear face of the slide chamber section 26. Opening the slide chamber section 26 of the gun system 12 aligns the projectile transfer sleeve 44 with the bore of the forward gun barrel section 22 while achieving the same alignment between the propellant transfer sleeve 46 and the bore of the slide chamber section 26. The hot stub case 40 from the previously fired round is translated with the slide chamber section 26. Once the slide chamber section 26 is fully opened the projectile 54 is rammed forward out of the projectile transfer sleeve 44 and into the bore of the forward gun barrel section 22. Concurrently the propellant charge 52, including its own stub case 40, is rammed rearwards into the bore of the slide chamber section 26. The ramming of the propellant charge 52 also ejects the hot stub case 40 and any residual propellant gas from the previously fired round out of the slide chamber section 26 and through the resupply and ejection sleeve 48. A door on the resupply and ejection sleeve 48 opens and closes immediately prior to and following ejection of the hot stub case 40. Once the projectile 54 and propellant charge 52 are properly loaded, the slide chamber section 26 is ready to be closed. Closing the slide chamber section 26 of the gun system 12 aligns the bores of the rear gun barrel section 24, slide chamber section 26, and forward gun barrel section 22 while the projectile 54 and propellant charge 52 are contained with the forward gun barrel section 22 and slide chamber section 26, respectively. Once the chamber is closed, the rear gun barrel section 24 and slide chamber section 26 are translated forward slightly, with the rear gun barrel section 24 translating just a bit further to close the gaps between the front and rear face of the slide chamber section 26 and pre-load the chamber seals 32. Once the slide chamber section 26 is closed, the gun system 12 is ready to fire the next round.

For a tank gun, the value for sonic speed changes with respect to time and position within the gas column are approximately one meter per millisecond. Gas velocity for a tank gun firing a round with a muzzle velocity of 1,500 m/s should average to less than one meter per millisecond. Thus, the back of a 5.3 meter long barrel, such as an M256, may be unplugged in the range of two milliseconds before projectile exit. At this point in time, the projectile has traversed roughly one third its travel down the bore. Additionally, the method does not eject propellant gases until well into the interior ballistic cycle; after appreciable expansion may have occurred. Therefore, a substantially reduced pressure may be exposed to the contraction-expansion nozzle, which becomes more pronounced with high expansion ratio guns that provide large travel to bore diameter ratios. This increases the practicable interior ballistics operating pressures attainable before thermal-erosion of the nozzle prevents implementation using currently available materials. The present invention further provides exhausting propellant gases out of the gun bore prior to shot exit having substantially reduced net heat transfer to the gun barrel by reducing the time of exposure and temperature of the gases in contact with the bore of the gun. Also, for much of the cannon bore, the speed of the propellant gases will be reduced, thus decreasing the scouring of the boundary layer adding further reduction in the drivers of heat transfer.

By its location at the rear of the gun, the method better enables the use of nozzles of sufficient surface area to efficiently allow adiabatic expansion of the high energy propellant gases. Also, as is the case for muzzle brakes, the additional weight of the nozzle will reduce recoil energy as long as the nozzle is coupled to the recoil gun parts. Finally, location of the nozzle weight to the rear of the trunnions will favorably affect the balance of the gun system. Additionally, nozzle efficiency may also increase because traditional recoilless gun nozzle design must consider all interior ballistic pressures. The current invention may be designed for pressures after the sharp interior transient peak pressure. Nozzle efficiency may be further increased by the incorporation of variable expansion ratio nozzles whose geometry changes as a function of recoil motion.

The muzzle blast that follows the round out of the gun barrel may be dramatically reduced by the present invention. This may be achieved by timing the sonic rarefaction wave to coincide with or precede projectile exit from the muzzle.

The gun system 12 may be designed to automatically operate in closed-breech mode when firing low impulse rounds. By designing the actuation method for the breech valve 14 to be a function of the impulse imparted to the recoiling gun mass, such that the valve at the rear of the gun is not opened without sufficient impulse. Under such closed breech operation, a traditional recoil system will function to absorb the low recoil energy imposed upon the gun system by the low impulse round.

The present invention provides a low recoil gun that dramatically reduces recoil energy manifest as reduced kinetic energy of recoiling gun parts, with substantial or complete elimination of recoil energy possible. This reduces the imposition of recoil momentum and energy upon mobile weapon platforms such as aircraft, spacecraft, and fighting vehicles. Reduced mass requirements placed upon recoiling gun parts also occurs within the present invention. Although efforts have been made to reduce the weight of recoiling gun systems components such as the breech, these efforts result in new problems manifest as recoil challenges. Gun mass is largely dictated by the need to control the kinetic energy of recoil. It may be shown that the trinnion pull of a traditional recoiling gun is inversely proportional to the recoiling mass when all other design parameters are held constant. Reduced heat transfer to the gun barrel enhances thermal management of the system and reduce the need for radial conduction of heat from the bore through the barrel to the surface. Reduction in muzzle blast may favorably affect the projectile dispersion, and projectiles will no longer encounter muzzle gases rush past immediately following shot exit. Reduction in muzzle blast will also reduce obscuration that results from the raising of dust by muzzle blast. Efficient nozzle design, that enables greater adiabatic expansion of the propellant gases, may better incorporate flash, smoke, and noise suppression that was possible with traditional recoilless rifles.

This will be aided by avoiding gross under or over expansion of the nozzle design. Muzzle blast signature will be dramatically reduced. While it is anticipated that the signature of the discharged gases may be substantial, the turret lays between this blast and the targeted threat system that the gun is engaging. Thus, the gun turret itself will reduce the observability of the back blast. This is in sharp contrast to the muzzle blast of a traditional gun system that prominently displays its signature to the targeted enemy in front of the turret. Closed breech operation for low impulse rounds may be of particular advantage in a military operations in urban terrain (MOUT) environment where the back-blast associated with recoilless operation could result in unacceptable danger to nearby civilians, friendly troops, and civil structures. Unlike a muzzle brake, which directs shock waves back at the vehicle, the shock waves exhausted out the back of the sonic rarefaction wave recoilless gun system 10 by the nozzle will travel away from the vehicle.

EXAMPLE

Sonic Rarefaction Wave for an M256 120 mm Firing an Ambient M829A2 Round

Interior ballistics analysis of an M256 120 mm tank cannon firing an M829A2 round at ambient temperature resulted in data of propellant gas pressure, temperature, position, and velocity within the gun at 15 time intervals and 25 interior position data points. This analysis was conducted using the industry standard one dimensional interior ballistic simulation code called "XNOVAKTC" authored in 1990 by Paul Gough Associates of Portsmouth, N.H. In addition to the NOVA simulation, a table of thermodynamic properties of the propellant gas as a function of pressure and temperature was used. Together, the NOVA simulation and table enabled analysis of the trajectory that a sonic rarefaction wave would take, during the interior ballistic launch of a well studied and relevant gun system.

Analysis was conducted using MATLAB, authored by Mathwork, Inc. of Natick, Mass., to determine the time at which the breech could be vented, and the resulting sonic rarefaction wave would reach the muzzle of the gun coincident with the exit of the base of the projectile. To achieve this, the rather coarse time resolution of the data was splined to a finer temporal resolution. In FIGS. 4–9, data that is direct from the original data files is be represented as dots, with the splines represented by continuous lines. Since the sonic rarefaction wave travel arbitrarily in both space and time, a spatial spline was applied to the data at each time step. Thus the data was effectively double splined for the analysis.

The start time of the sonic rarefaction wave was determined by a backward propagation of the wave from the muzzle at the moment of shot exit. The speed of the wave was computed as the sum of the sonic speed and gas speed, both of which were extracted from the XNOVAKTC data. 500 equidistant time steps were splined from the raw data for this computation. The backward motion of the rarefaction wave in reserve time was computed by the subtraction of the sonic rarefaction wave velocity multiplied by the step duration from the previous rarefaction wave front position.

Figure 4:
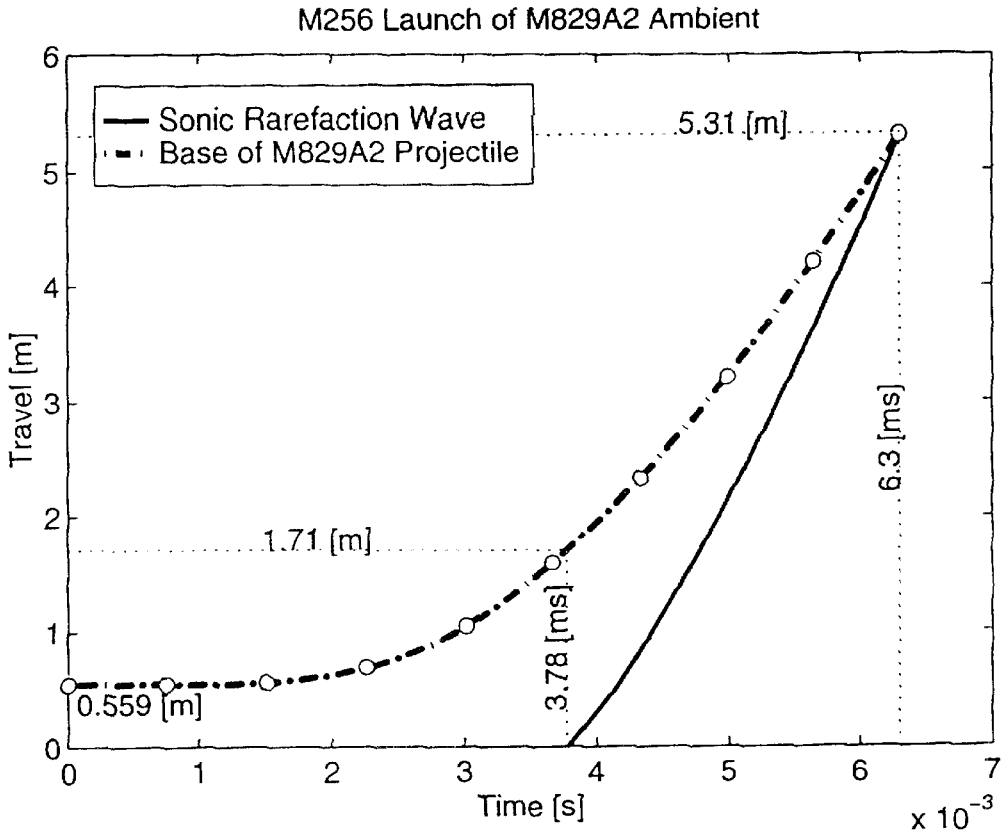
FIG. 4 is a plot of the rarefaction wave and projectile position versus time for the present invention.

A plot of the position with respect to time for both the sonic rarefaction wave and the projectile is depicted in the plot shown in FIG. 4. Both meet contemporaneously at the muzzle if the sonic rarefaction wave is released at time 3.78 milliseconds into the interior ballistic cycle. The projectile has traveled less than one third down the 5.3 meter long barrel at this point in time.

Figure 5:
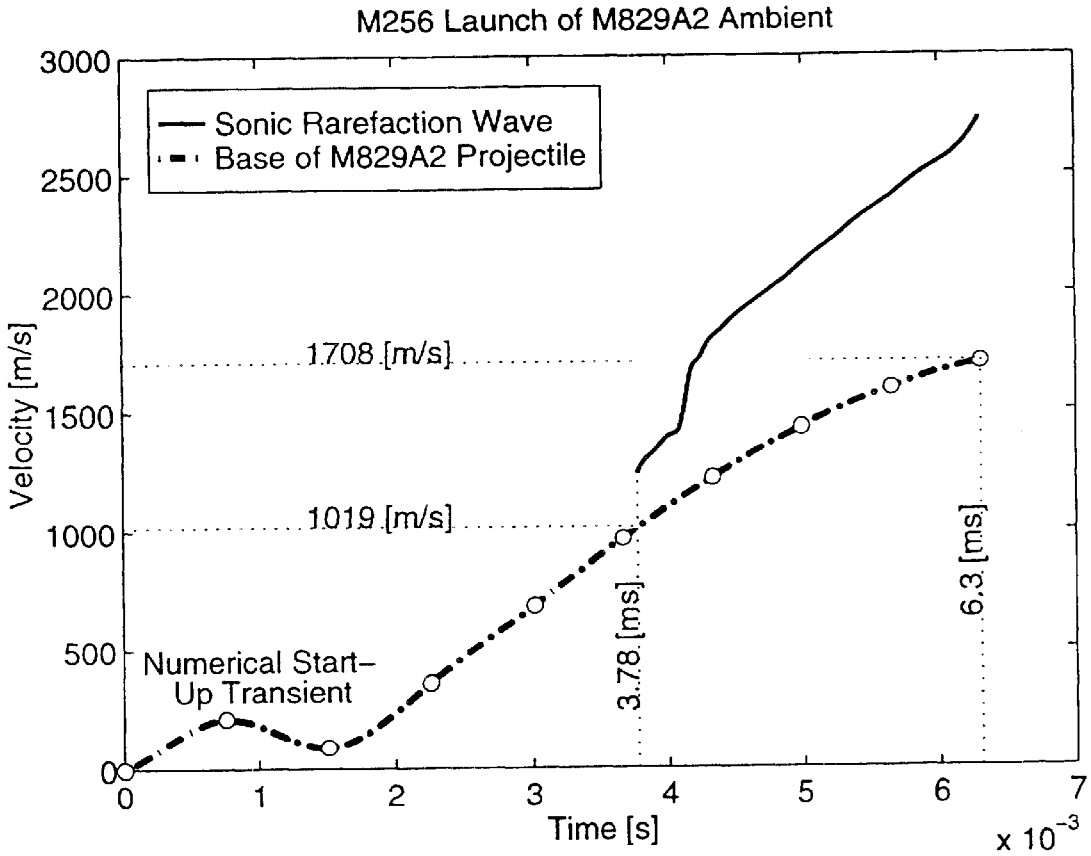
FIG. 5 is a plot of the rarefaction wave and projectile speed versus time for the present invention.

A plot of the speed with respect to time for both the sonic rarefaction wave and the projectile is depicted in the plot shown in FIG. 5. As seen in FIG. 5, the sonic rarefaction wave speeds up as it propagates forward into higher velocity gases.

Figure 6:
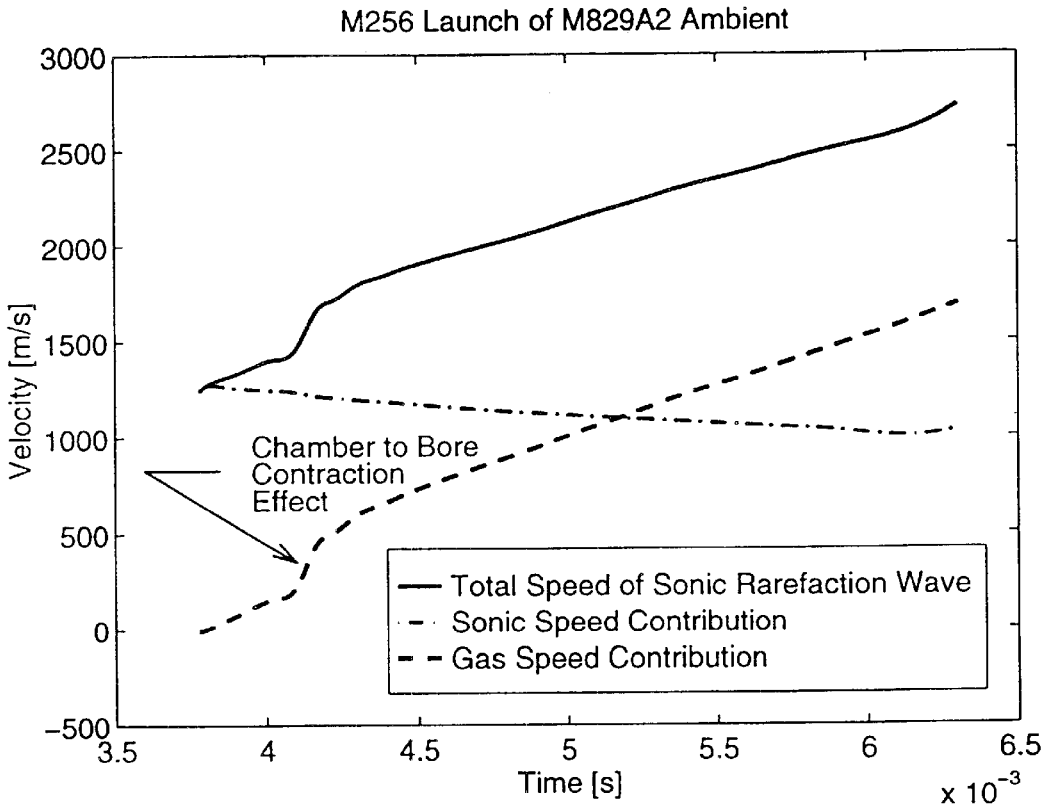
FIG. 6 is a plot of the rarefaction wave and projectile speed versus time for the present invention.

A plot of the speed with respect to time for both the sonic speed and gas speed contribution to net rarefaction wave speed is depicted in the plot shown in FIG. 6.

Figure 7:
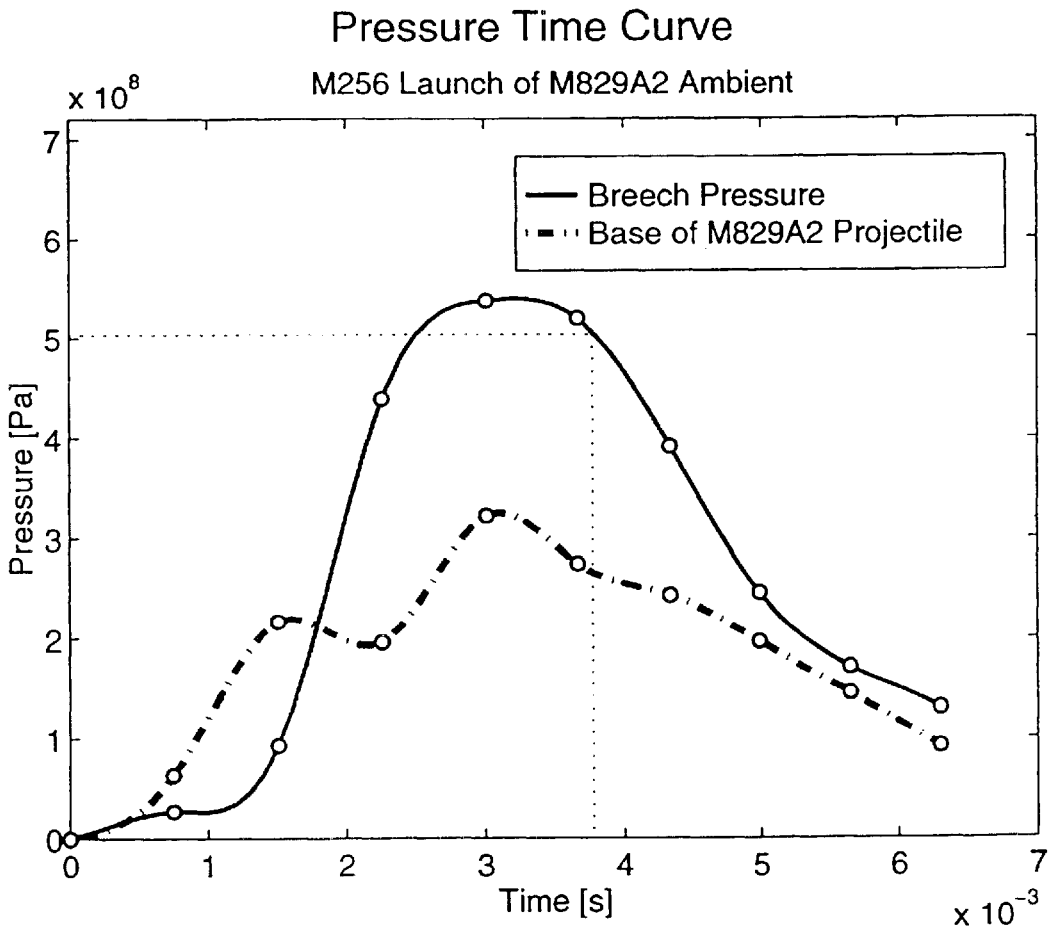
FIG. 7 is a plot of pressure versus time for the present invention.

A plot of the pressure with respect to time for both the breech and rear face of the projectile is depicted in the plot in FIG. 7. The effective pressure pushing the projectile is lower because of the gas enthalpy lost to the kinetic energy of the propellant gas that propel the projectile forward. It can be seen from FIG. 7 that the pressure at the breech of the gun, when the rarefaction wave could be released is very high, 503 MegaPascals. The data point is highlighted by the vertical and horizontal dotted lines leading up from the release time of 3.78 milliseconds.

It has been computed that if the venting were to occur a 3.78 milliseconds through a nozzle throat of the same diameter as the bore (120 mm) with no provision for an expansion nozzle, the recoil momentum would be reduced by 57% over that of the traditional gun incorporating no muzzle brake. This represents a lower bound on anticipated performance as the integration of an expansion nozzle will substantially increase the forward thrust generated by the venting.

If a 120 mm XM291 were used, with the same in-bore geometry as the M256 excepting for a total length of 6.75 meters, the timing of the sonic rarefaction wave would be delayed to 4.1 milliseconds between of the extra travel. This would expose the nozzle to a breech pressure of 465 MegaPascals. These numbers were computed using the same analysis presented for the M256. Clearly, the longer the gun, the longer the delay time between opening the breech valve, and communication of the forward by the sonic rarefaction wave. Also, the longer the gun, the lower the peak pressure exposed to the nozzle. The desire to lower the pressure initially exposed to the nozzle could provide impetus for the development of a traveling charge projectile, even if the traveling charge is only slightly effective.

Figure 8:
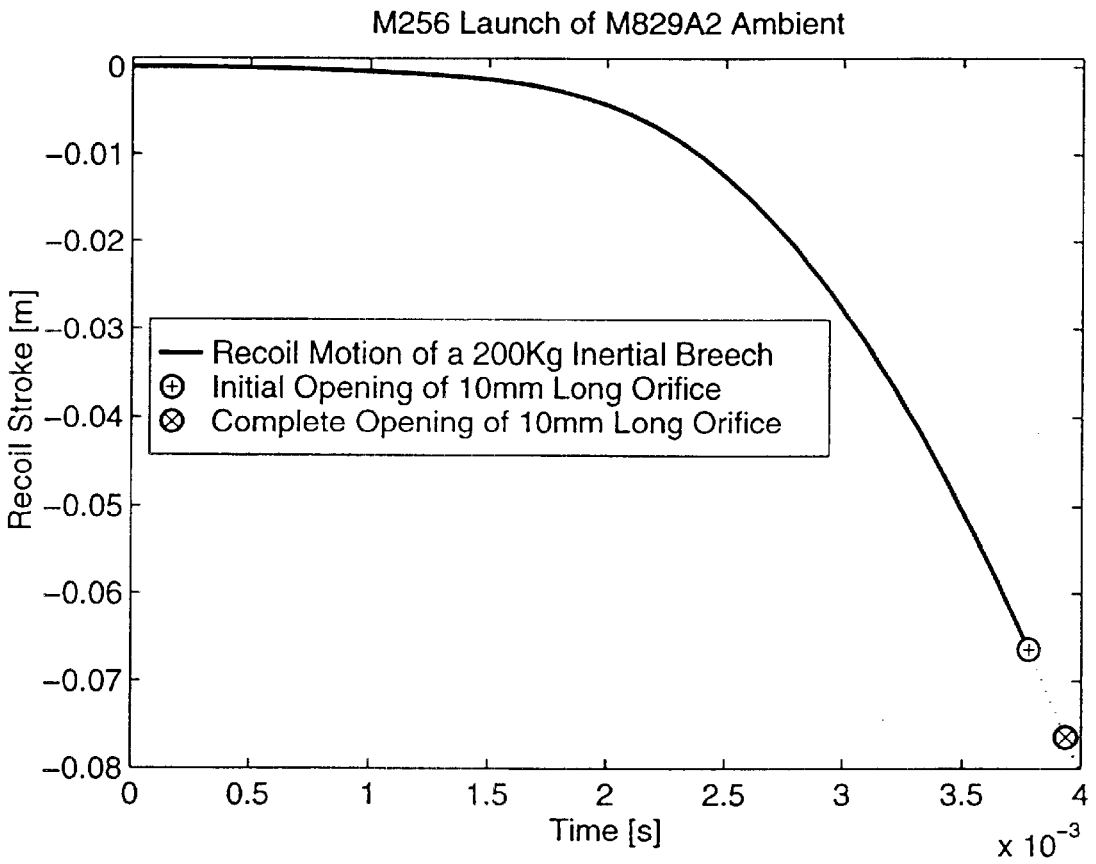
FIG. 8 is a plot of the speed of orifice exposure for the present invention; and, FIG. 9 is a plot of nozzle start thrusts and breech force versus time for the present invention.
Figure 9:
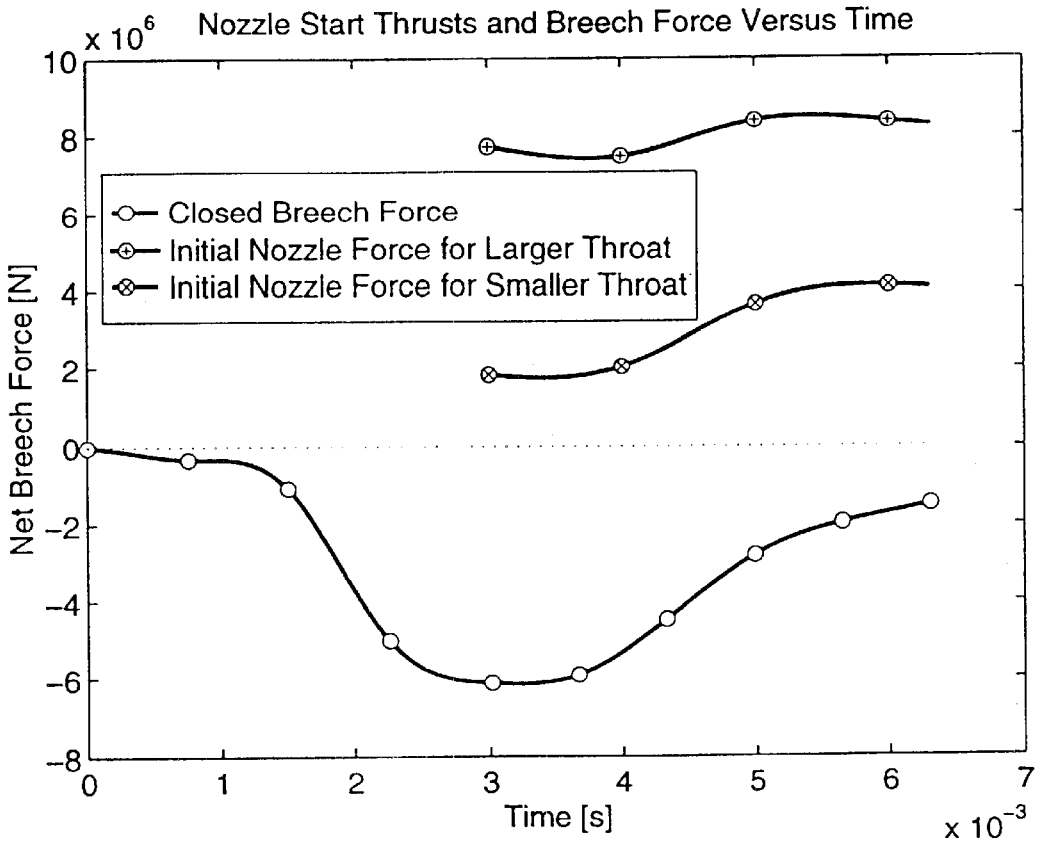

Of substantial concern was how fast the breech valve may be fully opened. Although not fully accurate, a good estimate of the inertial breech recoil motion for a gun system similar to the M256 firing the M829A2 round may be arrived at by application of the M256 pressure time curve to a 120 mm inertial breech. The error range remains small, as long as the breech mass is substantially higher than that of the M829 round. In FIG. 8, a 200 Kg breech (roughly an order of magnitude greater in mass than the M829A2 round) is driven by the propellant gas pressure across the 120 mm diameter exposed breech face. As indicated in the FIG. 8, a 10 mm orifice may be a completely uncovered in 0.16 milliseconds while a 30 mm orifice would be completely uncovered in 0.48 milliseconds. Such an orifice would begin at 66 millimeters behind the obturation seal achieved between the stub case and rear gun barrel section. Thrust applied by the nozzle commences as soon as the orifice exposure starts. This will slow the rearward speed of the inertial breech, thus lengthening the time to achieve full exposure of the orifice somewhat from the above predictions. This increase in duration will be slight as substantial momentum is manifest within the inertial breech as a result of the closed-breech launch prior to orifice exposure.

Some benchmark numbers were generated to demonstrate that the discharge area of the nozzle is not impractical for a fighting vehicle, and to demonstrate that substantial thrust may be developed during operation. When the nozzle is first enabled, the stagnation properties of the propellant gases at the front face of the breech were read off of the data sets. Table 2, below, shows some generated sample gas properties using adiabatic one dimensional nozzle analysis. Assumptions in the generated properties included the throat area flow path enabled by the barrel scallops 14*a* and breech scallops 14*b* to equal the bore area. Two exit area cases are presented in the Tables 1 and 2, below. In the first case, the diameter of the expansion nozzle is assumed four times the bore diameter, and in the second case eight times the bore diameter. Substantial increases in thrust do not accompany dramatic increases in exit area, however, substantial increases in exit area reduce the pressure and temperature of the propellant gases potentially aiding in the reduction of spontaneous combustion of the propellant gas as it passes through the external shock wave to a velocity less than Mach 1, i.e., further expansion may control secondary flash. Other signature control issues may also be enhanced by a more full expansion of the ejected propellant gases.

Global properties of the nozzle for all eight cases to be considered in Table 2 are presented below in Table 1:

TABLE 1

Global Properties of Nozzle Example

| | | |
|---|---|---|
| Ratio of Specific Heats | $\gamma$ | 1.225 |
| Molecular Weight | [Kg/kmol] | 25 |
| Universal Gas Constant | R [J/(kmol K)] | 8,314 |
| Area of Bore | $\pi \times (d_b/2)^2$ [m$^2$] where $d_b$ = 0.120 m | 11.3 $10^{-3}$ |
| Area of Throat | $\pi \times (d_b/2)^2$ [m$^2$] where $d_b$ = 0.120 m | 11.3 $10^{-3}$ |
| Area of Nozzle Exit Case 1 | $\pi \times (d_e/2)^2$ [m$^2$] where $d_e$ = 0.480 m | 181 $10^{-3}$ |
| Area of Nozzle Exit Case 2 | $\pi \times (d_e/2)^2$ [m$^2$] where $d_e$ = 0.960 m | 723.8 $10^{-3}$ |
| Expansion Ratio Case 1 | $\epsilon_1$ | 16 |
| Expansion Ratio Case 2 | $\epsilon_2$ | 64 |

Application of adiabatic nozzle flow analysis results in the eight nozzle configurations/conditions listed in Table 2, below. The reservoir conditions were drawn from validated interior ballistic simulation using the XNOVAKTC Code of the M256 120 mm tank cannon firing the M829A2 kinetic energy round. The adiabatic and ideal gas assumptions are employed only to provide perspectives of the thrusts achievable.

TABLE 2

Thrust Computations for Nozzles Subject to Different Reservoir Stagnation Conditions

| | Reservoir Conditions at Breech at 3 ms | | Reservoir Conditions at Breech at 4 ms | | Reservoir Conditions at Breech at 5 ms | | Reservoir Conditions at Breech at 6 ms | |
|---|---|---|---|---|---|---|---|---|
| $P_o$ [MPa] | 538 | | 467 | | 243 | | 150 | |
| $T_o$ [K] | 2,590 | | 2,422 | | 2,128 | | 1,938 | |
| $\rho_o$ [Kg/m$^3$] | 625 | | 580 | | 343 | | 233 | |
| $c_o$ [m/s] | 1,027 | | 993 | | 931 | | 889 | |
| T* [K] | 2,328 | | 2,177 | | 1,913 | | 1,742 | |
| $\rho$* [Kg/m$^3$] | 389 | | 361 | | 214 | | 145 | |
| c* [m/s] | 974 | | 942 | | 883 | | 842 | |
| mdot [Kg/s] | 4,280 | | 3,850 | | 2,140 | | 1,380 | |
| $\epsilon$ | 16 | 64 | 16 | 64 | 16 | 64 | 16 | 64 |
| $M_e$ [Mach #] | 3.70 | 4.75 | 3.70 | 4.75 | 3.70 | 4.75 | 3.70 | 4.75 |
| $P_e$ [MPa] | 3.37 | 0.556 | 2.92 | 0.483 | 1.52 | 0.251 | 0.94 | 0.155 |
| $T_e$ [K] | 1,020 | 733 | 954 | 685 | 838 | 602 | 763 | 548 |
| $\rho_e$ [Kg/m$^3$] | 9.93 | 2.28 | 9.21 | 2.12 | 5.46 | 1.26 | 3.70 | 0.85 |
| $c_e$ [m/s] | 645 | 546 | 623 | 528 | 584 | 495 | 558 | 473 |
| Ve [m/s] | 2,384 | 2,593 | 2,306 | 2,508 | 2,162 | 2,351 | 2,062 | 2,243 |
| Impulse [MN] | 7.62 | 8.51 | 6.61 | 7.39 | 3.44 | 3.85 | 2.13 | 2.38 |
| Nozzle Area Force [MN] | 0.61 | 0.10 | 0.53 | 0.087 | 0.28 | 0.045 | 0.17 | 0.028 |
| Breech Area Force [MN] | −6.09 | | −5.28 | | −2.75 | | −1.70 | |
| Σ Thrust [MN] | 2.14 | 2.53 | 1.86 | 2.19 | 0.968 | 1.14 | 0.598 | 0.705 |

The notation used in Table 2 includes where "$_o$" refers to stagnation or reservoir values; "*" refers to throat values; "$_i$" refers to inlet values, essentially the same as stagnation; and "$_e$" refers to exit values. Nozzle flow equations are well known, and may be found in standard references such as Van Wylen and Sonntag, "Fundamentals of Classical Thermodynamics," 3$^{rd}$ Ed., 1985, the disclosure of which is herein incorporated by reference, including:

$$c=(\gamma RT)^{1/2}$$

$$mdot=\rho AV$$

$$M=V/c$$

$$T_o/T=1+((\gamma-1)/2)M^2$$

$$P_o/P=[1+((\gamma-1)/2)M^2]^{\gamma/(\gamma-1)}$$

$$\rho_o/\rho=[1+((\gamma-1)/2)M^2]^{1/(\gamma-1)}$$

$$F=m(V_e-V_i)-P_iA_i+P_eA_e \text{(impulse+breech area force+nozzle exit area force)}$$

$$A/A^*=1/M[(2/\gamma-1)(1+(\gamma-1)M^2/2)]^{(\gamma+1/2(\gamma-1))}\rightarrow M|_{A=A^*}=1.$$

The stagnation temperature, pressure, and density values were drawn from the simulation data of the Example. For point of reference, atmospheric pressure is 0.101 Mpa.

The net thrust is the combination of the various forces acting upon the nozzle and represents the total force applied to the inertial breech; including the in-bore pressure that is attempting to drive it rearwards. The breech area force is simply the rearward forces the propellant gases would be applying to the breech whether the nozzle is activated or not. This force is dramatic for high reservoir pressures, and nearly overshadows the thrust developed by the expanding gases, predominately the impulse generated by their high velocity exit. The impulse is the mass flow rate multiplied by the change in velocity which has equivalent units of force. The back pressure applied by the exiting gases against the exit nozzle area is small in all cases.

The thrusts developed after the initial exposure have not been computed. For the large orifice nozzle enabled at 3 milliseconds, the entire charge mass would be ejected in less than 2 milliseconds if its flow rate could be sustained; which will clearly not happen. However, it may be said rather conclusively from the resulting thrust data tabulated in Table 2 that once the nozzle is enabled, a forward thrust will continue as the pressure in the bore is reduced. Therefore, all of the rearward momentum imparted to the recoiling mass of the gun system will be halted once a nozzle of sufficient throat area is enabled. The XNOVAKTC simulation of a close breech gun indicates that 57% of the total momentum imparted to the gun occurs after the breech could vent without compromising projectile propulsion. Thus, a trivial nozzle with no expansion coupled to an ideal valve that opened a throat of the same area as the bore would eliminate 57% of the momentum. This may be considered to represent a minimum level of anticipated performance.

Full recoilless operation would be achieved when the area under the force time curve during closed breech operation, ie., negative force, equals the area under the curve during nozzle operation, i.e., positive force. The blow down momentum, is that imparted to the recoiling gun mass after projectile 54 exit by the escaping propellant gases, is not shown in FIG. 9.

It should be understood that the foregoing summary, detailed description, examples and drawings of the invention are not intended to be limiting, but are only exemplary of the inventive features which are defined in the claims.

What is claimed is:

1. A gun system for firing a projectile using propellant gases evolved by burning a moving column of distributed propellant grains, comprising:

a barrel having a forward gun barrel section, a rear gun barrel section, and a bore that extends between the forward gun barrel section and the rear gun barrel section;

the rear gun barrel section having a delayed pressure release mechanism located behind the projectile;

wherein the delayed pressure release mechanism causes a delayed release of the propellant gases at a distance behind the projectile, after the projectile has begun motion along the bore of the barrel, but before exiting the barrel;

wherein the released propellant gases are expelled in part outside the gun system, and are expanded through a nozzle to generate a forward thrust and to reduce a momentum imparted to the gun system; and wherein the delayed release of the propellant gases is timed to cause a sonic rarefaction wave to travel along a length of the barrel bore between a location of the delayed pressure release mechanism at the time of the pressure release and any of a position of a base of the projectile when the rarefaction wave reaches the projectile base, or a muzzle of the barrel at some time following a projectile exit if the projectile exits the gun prior to being overtaken by the rarefaction wave.

2. The gun system of claim 1, wherein the delayed pressure release mechanism includes the rear gun barrel section that defines at least one pressure release conduit between the bore and outside the rear gun barrel section.

3. The gun system of claim 2, wherein the delayed pressure release mechanism includes a valve opening device.

4. The gun system of claim 3, wherein the delayed pressure release mechanism includes an inertial breech device.

5. The gun system of claim 2, wherein the pressure release conduit includes variable throat areas.

6. The gun system of claim 4, wherein the inertial breech device includes a recoil activated mechanism.

7. The gun system of claim 3, further including a recoil brake and a recuperator.

8. The gun system of claim 1, further including a stub case located adjacent to the delayed pressure release mechanism, against which the propellant gases are released at firing.

9. The gun system of claim 1, wherein the delayed release of the propellant gases occurs when the projectile has traversed from about ¼ to about ½ of the length of the barrel.

10. The gun system of claim 1, wherein the delayed release of the propellant gases at some distance behind the projectile causes the sonic rarefaction wave front to arrive at the muzzle of the barrel after the projectile has exited the muzzle.

11. The gun system of claim 1, wherein the delayed release of the propellant gases at some distance behind the projectile causes the sonic rarefaction wave front to arrive at the base of the projectile substantially coincident with the exiting of the projectile from the muzzle.

12. The gun system of claim 1, wherein the delayed release of the propellant gases at some distance behind the projectile causes the sonic rarefaction wave front to arrive at the base of the projectile prior to the exiting of the projectile from the muzzle, but after the projectile has traversed a predetermined distance of the barrel length while the rarefaction wave front travels from a release point to the base of the projectile.

* * * * *